US006096150A

United States Patent [19]

Ohno

[11] Patent Number: 6,096,150

[45] Date of Patent: Aug. 1, 2000

[54] AUTOMATIC PAPER-WEB SPLICING SYSTEM AND METHOD

[75] Inventor: Kinichiro Ohno, Machida, Japan

[73] Assignee: Tokyo Kikai Seisakusho, Ltd., Japan

[21] Appl. No.: 09/081,123

[22] Filed: May 19, 1998

[30] Foreign Application Priority Data

May 28, 1997 [JP] Japan ..... 9-138025

[51] Int. Cl.[7] ..... B65H 19/16

[52] U.S. Cl. ..... 156/157; 156/351; 156/358; 156/502; 156/504; 242/554.6; 242/555.5

[58] Field of Search ..... 156/157, 351, 156/358, 502, 504; 242/554, 554.1, 554.5, 554.6, 555, 555.3, 555.5

[56] References Cited

U.S. PATENT DOCUMENTS

| | | | |
|---|---|---|---|
| 2,536,153 | 1/1951 | Bishop | 242/554.1 |
| 3,123,316 | 3/1964 | Hornbostel, Jr. | 242/554.6 |
| 3,223,339 | 12/1965 | Justus et al. | 242/554.4 |
| 3,391,877 | 7/1968 | Angell et al. | 242/554.1 |
| 4,067,760 | 1/1978 | Nelson | 156/157 |
| 4,181,847 | 1/1980 | Buschmann et al. | 226/30 X |
| 4,390,388 | 6/1983 | Nagata et al. | 156/351 |
| 4,482,972 | 11/1984 | Lewis et al. | 101/181 X |
| 4,575,017 | 3/1986 | Pali | 156/157 X |
| 5,556,492 | 9/1996 | Vonderhorst et al. | 156/351 X |
| 5,772,150 | 6/1998 | Spatafora | 156/504 X |

FOREIGN PATENT DOCUMENTS

| | | |
|---|---|---|
| 42-20135 | 10/1942 | Japan . |
| 49-28601 | 7/1974 | Japan . |
| 1-127552 | 5/1989 | Japan . |
| 1-150666 | 6/1989 | Japan . |
| 1-303259 | 12/1989 | Japan . |
| 2-33618 | 7/1990 | Japan . |
| 4-223955 | 8/1992 | Japan . |

*Primary Examiner*—Mark A. Osele
*Attorney, Agent, or Firm*—McGlew and Tuttle, PC

[57] ABSTRACT

An automatic paper-web splicing system rotates a new paper roll being spliced, causes the peripheral speed thereof to agree with the traveling speed of a traveling web, and splices the start end of the new paper roll to the traveling web. The automatic paper-web splicing system directly detects via a detection mark provided on the outer peripheral surface of a new paper roll being spliced to a traveling web that the outer peripheral surface of the new paper roll is moved by a predetermined length by the rotation of the new paper roll, causes the time required for the new paper roll to move to agree with the time required for the traveling web to travel over the predetermined length, thereby causing the peripheral speed of the new paper roll to agree with the traveling speed of the traveling web, and carries out automatic splicing in this state.

12 Claims, 6 Drawing Sheets

AUTOMATIC PAPER-WEB SPLICING SYSTEM AND METHOD

FIELD OF THE INVENTION

This invention relates generally to an automatic splicing system and method, and particularly to an automatic splicing system and method in a paper feeding system for sequentially splicing a plurality of paper rolls to feed to a rotary press or other systems, in which a new paper roll that is on standby is driven to cause to rotate at a peripheral speed that agrees with the traveling speed of a traveling paper web that is fed beforehand (hereinafter referred to as a traveling web) and the starting end of the new paper roll is automatically spliced to the traveling web in that state.

BACKGROUND OF INVENTION

The so-called flying paster or speed matching system is well known in the trade where a new paper roll to be spliced is rotated so that the peripheral speed of the new paper roll agrees with the traveling speed of a traveling web to splice the start end of the new paper roll to the traveling web. Most important in an automatic splicing system is causing the peripheral speed of a new paper roll to agree with the traveling speed of a traveling web. Various techniques to achieve this were disclosed in Japanese Published Examined Patent Application No. Sho-49 (1974)-28601 and Japanese Published Examined Patent Application No. Hei-2 (1990)-33618.

Japanese Published Examined Patent Application No. Sho-49 (1974)-28601 discloses two means for detecting the peripheral speed of a new paper roll in an automatic paper-web splicing system in which the peripheral speed of a new paper roll is caused to agree with the traveling speed of a traveling web.

The first means comprises a rotating body coming in contact with the new paper roll to rotate in accordance with the rotation of the new paper roll, and pulse signal generating means for generating a pulse signal proportional to the rotation of the rotating body, thereby obtaining a voltage value proportional to the peripheral speed of the new paper roll.

The second means is as follows. A value proportional to the diameter value of the new paper roll and a value proportional to the rotating speed of the new paper roll are obtained, and a value proportional to the peripheral speed of the new paper roll is obtained by calculating both the signals. To obtain a value proportional to the aforementioned diameter value, the new paper roll R is supported by an open end of an arm 4 provided in an angularly movable manner, as shown in FIG. 6. The arm 4 is angularly moved to a position at which the outer peripheral edge of the new paper roll R is detected by the sensor K. The sensor K is provided at a predetermined location in the angularly movable range of the arm 4 in such a manner as to face the end face of the new paper roll R. Based on the fact that the amount of angular movement changes in accordance with the outside diameter of the new paper roll R, a voltage signal proportional to the amount of angular movement is amplified three times via a potentiometer 3 that interlocks with the angular movement of the arm 4, and then extracted as a signal proportional to the diameter value of the new paper roll R.

Japanese Published Examined Patent Application No. Hei-2 (1990)-33618 discloses the following technology. The rotating speed, that is, the number of rotations per a predetermined time of a new paper roll when the peripheral speed of the new paper roll agrees with the traveling speed of a traveling web is obtained by dividing the traveling speed of the traveling web by the peripheral surface length of the new paper roll. The rotation of the new paper roll is controlled to cause the new paper roll to be rotated at the rotating speed obtained so that the peripheral speed of the new paper roll agrees with the traveling speed of the traveling web.

A signal relating to the diameter, that is, the peripheral surface length (the peripheral surface length is the product of the diameter and a circular constant) of a new paper roll is obtained in the following manner. As shown in FIG. 7, a new paper roll R is supported by the open end of an arm provided in an angularly moveable manner, an appropriate arm phase (point a) is set as a reference phase, and a proximity switch and a sensor K are provided. When the arm reaches the reference phase, the proximity switch detects it and generates a reference signal. When the new paper roll R reaches an arm phase (point b) at which the new paper roll is pasted to the traveling web, the sensor K detects the outer peripheral edge of the new paper roll (the phase of the outer peripheral edge at that time is referred to as point c) and generates a detection signal. In the arrangement shown in FIG. 7, when the arm is angularly moved at a constant speed, the time required for the arm to move by a displacement angle $(\theta-\theta_x)$ from the reference signal output (point a) to the detection signal output (point b) changes in accordance with changes in the outside diameter of the new paper roll R. Taking advantage of this fact, a signal relating to the diameter, that is, the peripheral surface length of the new paper roll R can be obtain by causing the arm to angularly move at a constant speed.

The aforementioned prior-art techniques, however, have the following problems.

In the first means disclosed in Japanese Published Examined Patent Application No. Sho-49 (1974)-28601, the rotating body rotating while making contact with the outer peripheral surface of the new paper roll tends to slip on the outer peripheral surface of the new paper roll. If the new paper roll is loaded off-center, the rotating body may be bounced on the outer peripheral surface of the new paper roll. As a result, it is difficult to obtain a voltage signal corresponding to the correct peripheral speed of the new paper roll. This results in a difference between the peripheral speed of the new paper roll and the traveling speed of the traveling web, causing many inconveniences, such as paper web breakage during splicing. Furthermore, the first means is prone to mechanical troubles, requiring frequent maintenance.

The second means disclosed in Japanese Published Examined Patent Application No. Sho-49 (1974)-28601 obtains a voltage signal relating to the diameter of the new paper roll using a potentiometer. This arrangement tends to cause a difference in the amount of mechanical movement due to fitting allowances given to ensure smooth movement. This difference adversely affects the accuracy, resulting in a relatively large error. The second means detects the diameter of the new paper roll by detecting the outer peripheral edge of the new paper roll and amplifying it three times with a potentiometer. When the new paper roll is loaded off-center, therefore, an error from the correct diameter, if any, may be exaggerated three times. Furthermore, when these two problems are combined, a great difference might be produced between the detected value and the actual value of the diameter of the new paper roll. As a result, the peripheral speed of the new paper roll cannot be made equal to the traveling speed of the traveling web, causing the trouble of web breakage during splicing.

The prior art disclosed in Japanese Published Examined Patent Application No. Hei-2 (1990)-33618 was proposed to address the problem stated in Japanese Published examined Patent Application No. Sho-49 (1974)-28601, the problem of a kind that could be solved easily only if the traveling speed of the traveling web is about 10 meters per second. However, with the recent progress in paper web printing where the traveling speed of the traveling web is required to be as high as 15 to 20 meters per second, even the technical solution disclosed in Japanese Published Examined Patent Application No. Hei-2 (1990)-33618 can cause inconveniences.

That is, in the technical solution disclosed in Japanese Published Examined Patent Application No. Hei-2 (1990)-33618, an electrical signal relating to the diameter of a new paper roll is obtained to use in the control of the rotation of the new paper roll. To obtain the electrical signal, the outer peripheral edge of the new paper roll is detected. If the new paper roll is loaded off-center, therefore, no correct electrical signal can be obtained. For this reason, controlling the rotation of the new paper roll based on the electrical signal inevitably causes some difference between the peripheral speed of the new paper roll and the traveling speed of the traveling web. In addition, the traveling speed of the traveling web in the recent technology has been increased 1.5 times to twice that of the traveling web in the conventional technology. This has made the aforementioned difference in speed even larger in proportion to the increase in the traveling speed of the traveling web. If the peripheral speed or the rotating speed of the new paper roll is increased with increases in the traveling speed of the traveling web, the centrifugal force exerted on the new paper roll increased accordingly. Thus, the wobbling of the rotating new paper roll becomes larger than the actual degree of off-center of the new paper roll. When these two factors are combined, a great difference is produced between the peripheral speed of the new paper roll and the traveling speed of the traveling web, resulting in paper breakage during splicing.

SUMMARY OF THE INVENTION

It is an object of this invention to provide an automatic paper-web splicing system and method for splicing a traveling paper web to a new paper roll without causing paper breakage by solving the problems associated with the prior art.

It is another object of this invention to provide an automatic paper-web splicing system and method in which the start end of a new paper roll is spliced to a traveling web that travels at high speed without any inconveniences or troubles by controlling the rotation of the new paper roll in such a manner as to accurately detect the peripheral speed of the new paper roll particularly in the vicinity of the start end thereof to cause the peripheral speed of the new paper roll to agree with the traveling speed of the traveling web.

In the automatic paper-web splicing system and method according to this invention, the start end of a new paper roll being spliced is spliced to a traveling web by rotating the new paper roll, causing the peripheral speed of the new paper roll to agree with the traveling speed of the traveling web in such a manner that the movement of the outer peripheral surface of the new paper roll being spliced by a predetermined length by the rotation of the new paper roll is detected directly using a detection mark provided on the outer peripheral surface of the new paper roll, and the time required for the movement is caused to agree with the time required for the traveling web to travel over a predetermined length.

DETAILED DESCRIPTION OF THE PREFERRED EMBODIMENTS

Figure 1:
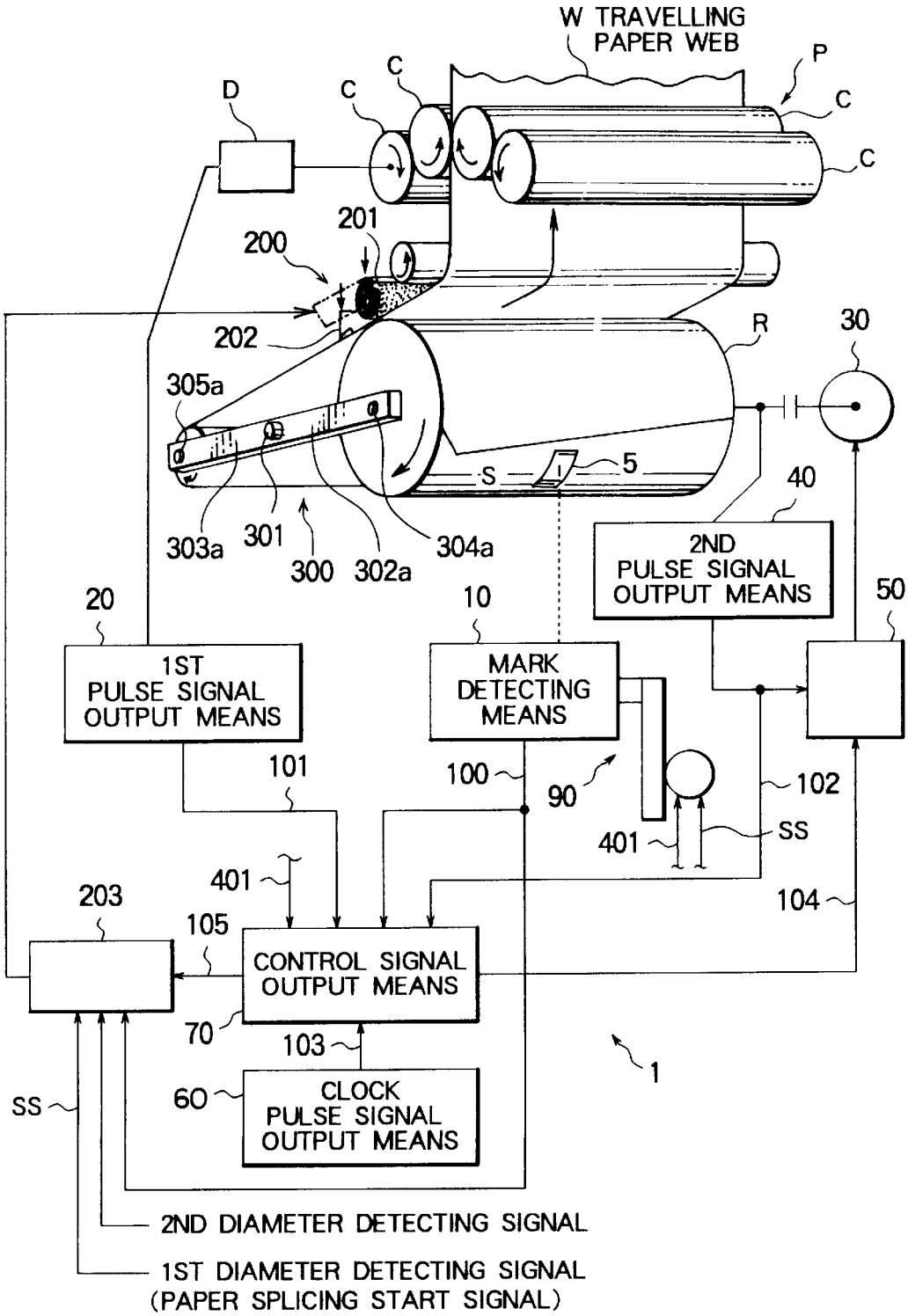
FIG. 1 is a block diagram illustrating the outline of an embodiment of this invention.

FIG. 1 is a block diagram illustrating the outline of an automatic paper-web splicing system embodying this invention. A new paper roll rotation control section 1 of the automatic paper-web splicing system shown in FIG. 1 comprises mark detecting means 10, first pulse signal output means 20, new paper roll drive means 30, second pulse signal output means 40, rotation control means 50, clock pulse signal output means 60 and control signal output means 70.

The mark detecting means 10 detects a detection mark 5 provided on the outer peripheral surface of a new paper roll R, and outputs a mark detection signal 100. The first pulse signal output means 20 outputs a first pulse signal 101 that is output in accordance with the traveling distance of a traveling web W. That is, a first pulse signal 101 the number of pulse outputs per unit time of which is proportional to the traveling speed of the traveling web W is output. The new paper roll drive means 30 drives the new paper roll R to cause to rotate. The second pulse signal output means 40 outputs a second pulse signal 102 that is output in proportion to the new paper roll rotating speed (or the peripheral speed of the new paper roll R). That is, a second pulse signal 102 the number of pulse outputs per unit time of which is in proportion to the number of rotation per unit time of the new paper roll drive means 30 is output. The rotation control means 50 controls the rotation of the new paper roll drive means 30 in a speed variable manner. The clock pulse signal output means 60 outputs a clock pulse signal 103 of a constant frequency. The control signal output means 70 receives signals 100, 101, 102 and 103 output by the mark detecting means 10, the first pulse signal output means 20, the second pulse signal output means 40 and the clock pulse signal output means 60, respectively, and generates a control signal 104 based on them and outputs it to the rotation control means 50. A control signal 104 is used for controlling the rotation of the new paper roll drive means 30 so as to cause the peripheral speed of the new paper roll R to agree with the traveling speed of the traveling web W. The control signal output means 70 outputs a speed matching signal 105 to a splicing section control means 203 when the peripheral speed of the new paper roll R has substantially agreed with the traveling speed of the traveling web W.

Figure 2:
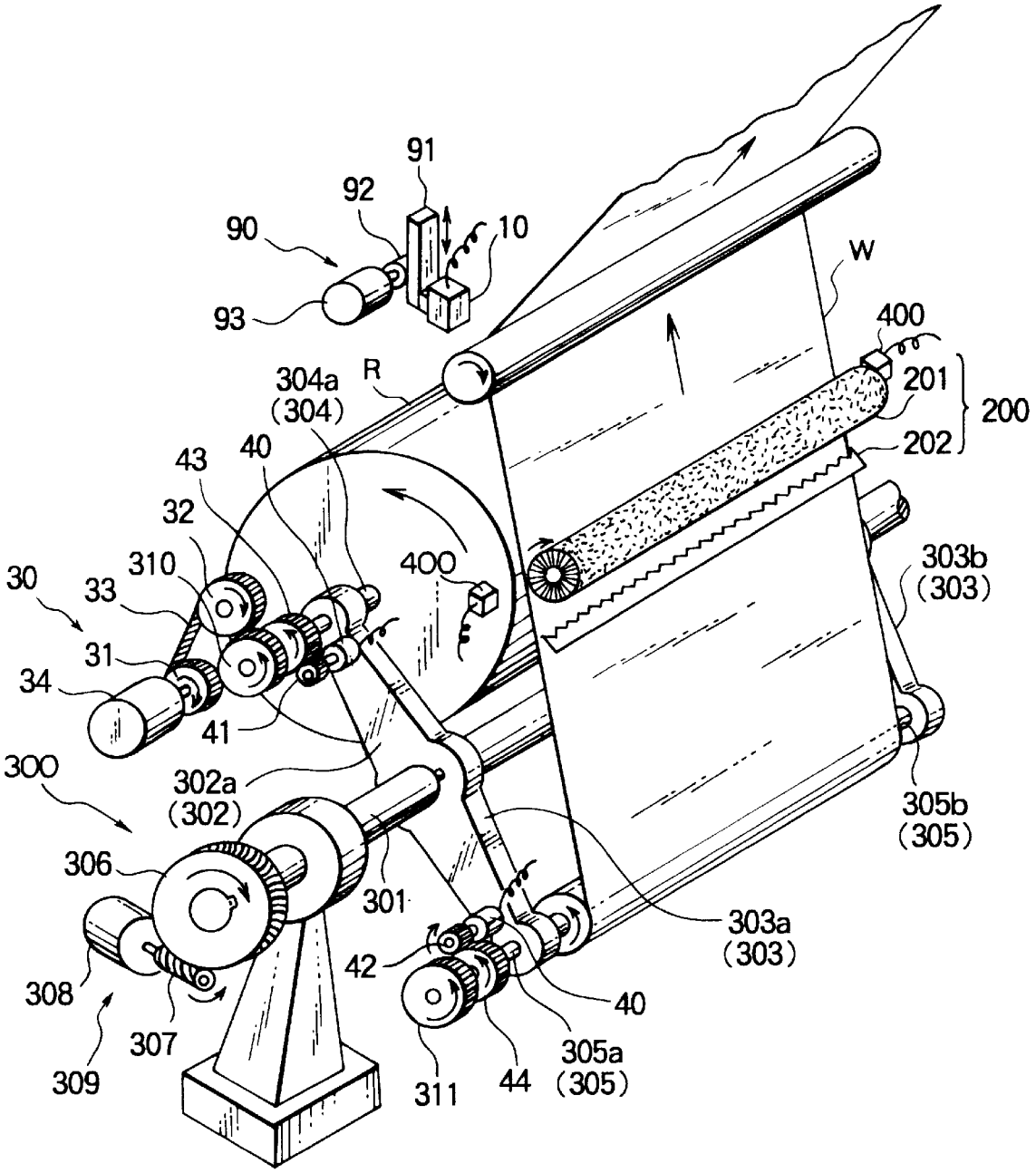
FIG. 2 is a perspective view illustrating in a more specific manner the mechanism of the embodiment shown in FIG. 1.

FIG. 2 shows the detailed mechanism of the automatic paper-web splicing system shown in FIG. 1. An embodiment of this invention in which processing apparatus is a printer will be described in detail, referring to FIGS. 1 and 2.

The automatic paper-web splicing system comprises a support section 300 for supporting a plurality (two in the embodiment shown in the figure) of paper rolls, a splicing section 200, and the new paper roll rotation control section 1 shown in FIG. 1. At the start end S of a new paper roll R provided in advance is an adhesive surface (not shown).

The splicing section 200 causes a traveling web W that is taken out of a paper roll supported by the support section 300 and caused to travel at a constant speed to processing apparatus P (the details of which are not shown) to make contact with the start end S of a new paper roll R that is on standby on the support section 300, splices both, and cuts the upstream side of the spliced portion of the traveling web W. The new paper roll rotation control section 1 control the rotation of the new paper roll R so as to cause the peripheral speed of the new paper roll R to agree with the traveling speed of the traveling web W.

The support section 300 has a shaft 301, two pairs of support arms 302*a* and 302*b* (not shown) and 303*a* and 303*b*, two pairs of support members 304*a* and 304*b* (not shown) and 305*a* and 305*b*. The shape formed by the support member 304*a*, the support arms 302*a* and 303*a* and the support member 305*a* is exactly the same as that formed by the support member 304*b*, the support arms 302*b* and 303*b* and the support member 305*b*, and both are provided on both sides of a paper web to support it.

The support arms 302*a* and 302*b* may sometimes be collectively called a support arm pair 302. The same applies to a support arm pair 303. Furthermore, the support arms 304*a* and 304*b* may sometimes be collectively called a support arm pair 304. The same holds true with a support arm pair 305.

The support arms are provided in multiple pairs; two pairs, for example. A pair of support arms 302*a* and 302*b*, for example, are rotatably provided together with the shaft 301 and in such a manner as to face each other on both sides of the shaft 301. The same applies to another pair of support arms 303*a* and 303*b*. The support members are provided on the support arms. A corresponding pair of support members 304*a* and 304*b* are provided on the ends of a pair of support arms 303*a* and 303*b* in such a manner that both the support members 304*a* and 304*b* face each other and are rotatable around a common centerline parallel with the shaft 301. The same applies to another pair of the support members 305*a* and 305*b*.

The support member pairs 304 and 305 each support a paper roll (a new paper roll R) as the support member pairs 304 and 305 tightly fit to the core of the paper roll from both sides thereof. In FIG. 2, the support member pair 304 support the new paper roll R, while the support member pair 305 support a traveling web W now in operation.

On an end of the shaft 301 provided is a shaft rotating means 309 for rotating the shaft 301 to cause the support arm pairs 302 and 303 to rotate simultaneously. The shaft rotating means 309 comprises a worm wheel 306, a worm 307 and a drive unit 308, for example.

On the support member 304*a* and 305*a*, which are counterparts of the support member pairs 304 and 305, provided are transmission members, toothed pulleys 310 and 311, for example. The toothed pulley 310 (or 311) is a transmission member that rotates together with the support member 304*a* or 305*a*, and is connected to the new paper roll drive means 30, which will be described later, to transmit rotation to the new paper roll R supported by the support member pair 304 (or 305). In FIG. 2, once the new paper roll R is spliced to the traveling web W, another new paper roll R is replenished on the support member 305. After that, as the support section 300 rotates around the shaft 301, the toothed pulley 311 moves to the position of the toothed pulley 310 in FIG. 2 to get enmeshed with the new paper roll drive means 30.

The splicing section 200 is provided in such a manner that the splicing section 200 can be moved to a splicing position on the opposite side of the new paper roll R with respect to the traveling web W when the shaft 301 of the support section 300 is caused to move by the shaft rotating means 309 to a splicing phase, that is, a phase where the traveling web W is brought close to the outer periphery of the new paper roll R, as shown in FIG. 2. The splicing section 200 has a pushing member 201 for forcing the traveling web W onto the outer periphery of the new paper roll R during splicing operation, and a cutter member 202 for cutting the downstream side of the pasting position of the traveling web W. In FIG. 2, the pushing member 201 comprises a rotatably provided brush roller. An appropriate mechanism for causing the splicing section 200 to move between the standby position to the splicing position is provided, but description of the mechanism has been omitted here since it is not related directly to this invention.

A pair of detecting means 400 are provided on both end faces of the new paper roll, as shown in FIG. 2, in the vicinity of the new paper roll R on the opposite side of the splicing section 200 with respect to the traveling web W. The detecting means 400 outputs a detection signal when the detecting means 400 detects that the outer periphery of the new paper roll R supported by the support member pair 304 (or 305) of the support arm pair 302 (or 303) reaches a position where the new paper roll R faces the traveling web W at a predetermined interval.

As shown in FIG. 1, the detection mark 5 is provided in the vicinity of the start end S on the outer periphery of the new paper roll R. The detection mark 5 may be provided directly in the vicinity of the start end. The detection mark 5 must include at least two marks spaced at a predetermined interval.

Figure 4:
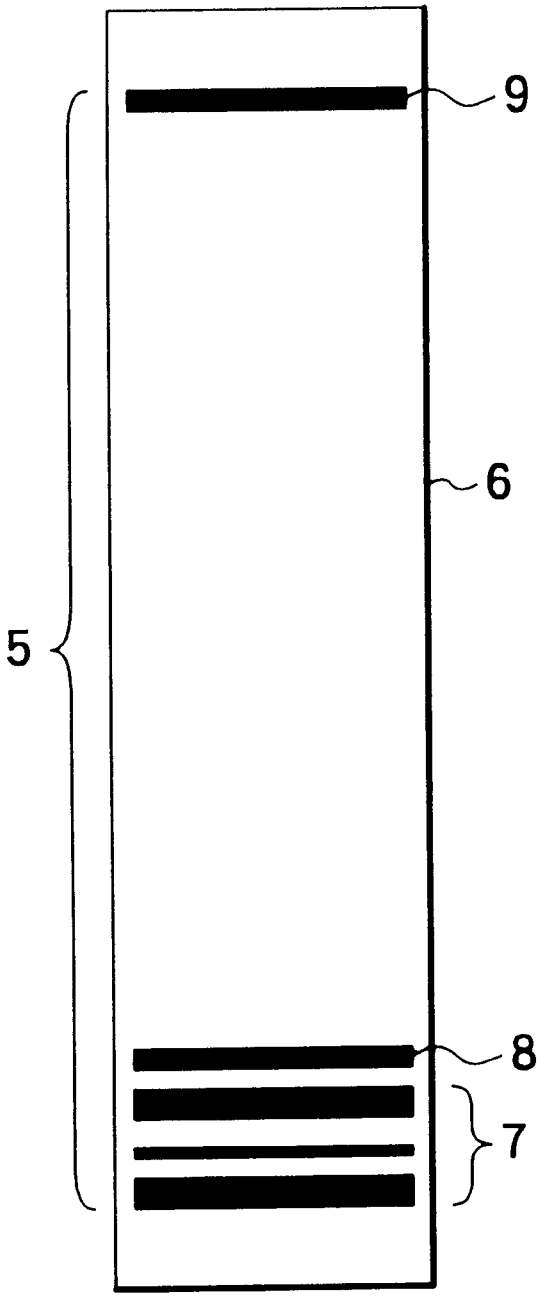
FIG. 4 is a diagram illustrating marks detected in the embodiment shown in FIG. 1.

To ensure high control accuracy, the accuracy of the detection mark 5 must be maintained at a high level. To this end, a mark tab 6 on which a detection mark 5 as shown in FIG. 4, for example, is printed in dark black is provided in advance. It is desirable to form a detection mark 5 by pasting a mark tab 6 in the vicinity of the start end S on the outer periphery of the new paper roll R.

The detection mark 5 shown in FIG. 4 comprises a start mark 7 on the leading side for detection (on the upstream side of the rotating new paper roll R), and a first detection bar 8 and a second detection bar 9 as the two marks spaced at a predetermined interval. The first and second detection bars 8 and 9 are provided in parallel to each other, with an interval set to a length equal to the distance the traveling web W travels during the period in which "100" pulses, for example, of the first pulse signal 101 are output. The start mark 7 is a mark indicating the start of the detection mark 5, comprising a plurality of bars provided in parallel with the first and second detection bars 8 and 9. The mark tab 6 is pasted at a predetermined position in the axial direction of the new paper roll R, with the first and second detection bars disposed at right angles with the side edges of the new paper roll R, similarly to the detection mark 5 shown in FIG. 1.

Mark detecting means 10 is provided in such a manner that the mark detecting means 10 faces the outer periphery of the new paper roll R when the support section 300 is in the splicing phase, and that the detection mark 5 provided at a predetermined position on the outer periphery of the new paper roll R can be detected. The mark detecting means 10 comprises a sensor of a type emitting and receiving a laser beam spot, for example. It is desirable to provide a dust-proof cover 11 (refer to FIG. 3), which can be opened by a solenoid actuator (not shown), in front of the laser beam emitting/receiving lens of the mark detecting means 10. The cover 11 can cover the laser beam emitting/receiving lens to prevent paper dust from adhering to the lens when the mark detecting means 10 is not in use. The solenoid actuator is opened by a control start instruction signal 401, for example, and closed by an appropriate signal output upon completion of splicing.

When a paper roll supplied and supported by the support section 300 as a new paper roll R is of different diameters, a great difference in diameter may be produced which is beyond the detectable range of the mark detecting means 10. In such a case, a mark detecting means carriage 90 is provided to cause the mark detecting means 10 to move over the outer periphery of the dew paper roll R and stop at a position falling within the range where the detection mark 5 can be detected.

The mark detecting means carriage 90 is provided in such a manner as to cause the entire unit of the mark detecting means 10 to move. The mark detecting means carriage 90 comprises a rack 91, a pinion 92 and a peripheral surface position sensor (not shown), as shown in FIG. 2. The rack 91 is provided in such a manner as to move along a linear guide (not shown) to bring the mark detecting means 10 close to and away from the outer peripheral surface of the new paper roll R. The pinion 92 is engaged with the rack 91 and connected to the output shaft of the drive unit 93. The peripheral surface position sensor is provided in such a manner that the sensor can be moved together with the rack 91 and detect the outer peripheral surface of the new paper roll R at a location that is a predetermined distance apart from the new paper roll R.

The mark detecting means carriage 90 is operated in the following manner. The drive unit 93 is actuated by a splicing start signal SS, which will be described later. With this, the rack 91 is first moved to a location remotest from the outer peripheral surface of the new paper roll R, then brought close to the outer peripheral surface of the new paper roll R by a signal (that is, control start instruction signal 401) indicating that the support section 300, which will be described later, is in a splicing phase, and the rack 91 is caused to stop as the drive unit 93 is stopped by a signal output by the peripheral surface position detecting sensor which detects the outer peripheral surface of the new paper roll R.

Consequently, both the mark detecting means 10 and the peripheral surface position detecting sensor are adjusted in such a manner that when the peripheral surface position detecting sensor detects the outer peripheral surface of the new paper roll R, the distance between the mark detecting means 10 and the outer peripheral surface of the new paper roll R is within a range detectable by the mark detecting means 10, and installed on the rack 91.

The first pulse signal output means 20 is provided by connecting to a member for causing the traveling web W to travel. As shown in FIG. 1, for example, the first pulse signal output means 20 is connected to a printing cylinder C in a printing system as processing apparatus P for causing the traveling web W to travel while printing thereon, or a drive means for driving the printing cylinder C. The first pulse signal output means 20 is a rotary encoder, for example, which outputs the first pulse signals 101 of a quantity corresponding to the traveling distance of the traveling web W driven by the rotation of the printing cylinder C.

The new paper roll drive means 30 is connected to the toothed pulley 310 (or 311) as means for transmitting the support section 300 when the support section 300 is in the splicing phase. To achieve this, the new paper roll drive means 30 has a double-toothed belt 33 installed between the two toothed pulleys 31 and 32, and a drive unit 34 for driving a toothed pulley 31 connected thereto. The new paper roll drive means 30 is provided in such a manner as to be movable between the new paper roll rotating position at which the toothed pulley 310 or 311 is connected to the double-toothed belt 33, and the standby position at which the double-toothed belt 33 is separated from the toothed pulley 310 (or 311). A mechanism for causing the new paper roll drive means 30 to move between the standby position and the new paper roll rotating position may be of any appropriate type, and the description thereof has been omitted here since it is not related directly to this invention.

The second pulse signal output means 40 is provided by connecting directly or indirectly to the output shaft of the drive unit 34 of the new paper roll drive means 30. In FIG. 2, the second pulse signal output means 40 comprises a rotary encoder installed in an appropriate manner on the support arms 302*a* and 303*a* of the support section 300. Gears 41 and 42 provided on the input shaft of the rotary encoder are engaged with gears 43 and 44 each rotatably and integrally provided on the support members 304*a* and 305*a*. Thus, the rotary encoder as the second pulse signal output means 40 is connected to the new paper roll drive means 30 via the gears 41 and 43, the support member 304*a* and the toothed pulley 310 (or via the gears 42 and 44, the support member 305*a* and the toothed pulley 311).

The second pulse signal output means 40 having the aforementioned connections is capable of outputting a pulse signal (hereinafter referred to as a second pulse signal 102) corresponding to the rotation of the support member 304*a* or 305*a* caused by the travel of the traveling web W. The number of outputs per unit time of the second pulse signals 102 is in inverse proportion to the diameter of a paper roll from which the traveling web W is fed. As will be described later, therefore, the second pulse signal output means 40 is used to output signals when the diameter of the paper roll from which the traveling web W is fed becomes smaller than the predetermined size thereof.

The rotation control means 50 controls the rotation of the drive unit 34 of the new paper roll drive means 30 when the new paper roll R is rotated as the control signal 104 output by the control signal output means 70, which will be described later, is input to the rotation control means 50, as shown in FIG. 1. The rotation control means 50 receives as a feedback signal the second pulse signal 102 output in accordance with the rotation of the drive unit 34 by the second pulse signal output means 40 to check to see if the rotation of the drive unit 34 is carried out in a desired state. The rotation control means 50 is an inverter control apparatus (refer to FIG. 3), for example.

The clock pulse signal output means 60 is an oscillator (OSC) outputting a clock pulse signal 103 of a constant frequency sufficiently higher than the maximum frequency of the first pulse signal 101, and outputs a clock pulse signal 103 of 276 kHz, for example. The higher the frequency of the clock pulse signal 103, the higher accuracy can be accomplished in the control performed by the control signal output means 70, which will be described later.

Figure 3:
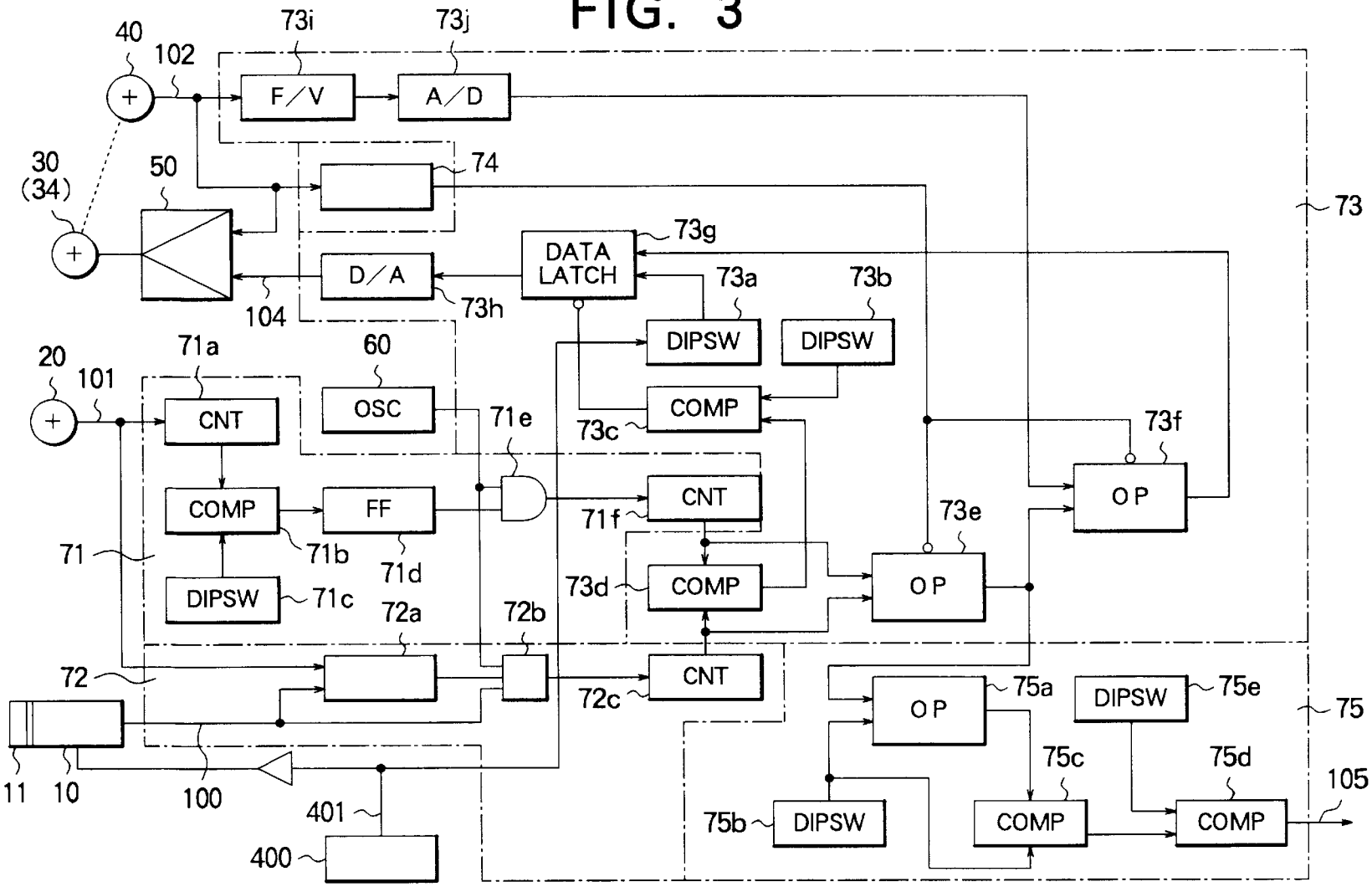
FIG. 3 is a block diagram of control signal output means in the embodiment shown in FIG. 1.

FIG. 3 is a block diagram of a control signal output means 70 in the embodiment shown in FIG. 1.

The control signal output means 70 comprises a web traveling speed recognition circuit 71, a new paper roll peripheral speed recognition circuit 72, a control signal output circuit 73, an operation inhibit signal output circuit 74, and a speed matching signal output circuit 75.

The web traveling speed recognition circuit 71 collects the first pulse signals 101, and counts the number of the clock pulse signals 103 that is output until the first pulse signals 101 reach a predetermined number. The web traveling speed recognition circuit 71 comprises a counter (CNT) 71*a*, a comparator (COMP) 71*b*, a dip switch (DIPSW) 71*c*, a flipflop circuit (FF) 71*d*, an AND gate circuit 71*e*, and a counter (CNT) 71*f*.

The peripheral speed recognition circuit 72 for the new paper roll R counts the number of clock pulse signals 103 that is output during the time elapsed from the detection of a first detection bar 8 following the detection of a start mark to the detection of a second bar 9 by the mark detecting means 10. The peripheral speed recognition circuit 72 comprises a start mark detection and confirmation circuit 72*a*, an AND circuit 72*b*, and a counter (CNT) 72*c*. The AND circuit 72*b* will be described later, referring to FIGS. 5A and 5B.

The control signal output circuit 73 calculates a first calculation result by comparing the number of clock pulse signals counted by the web traveling speed recognition circuit 71 and the number of clock signals counted by the peripheral speed recognition circuit 72, calculates a second calculation result based on the first calculation result and a value obtained by converting the second pulse signal 102 that is output by the second pulse signal output means 40, holds the second calculation result as control data, sets an insensitive zone in which alteration of control data is prohibited, and outputs a control signal 104 in accordance with the control data. The control signal output circuit 73 comprises a dip switches (DIPSW) 73*a* and 73*b*, comparators (COMP) 73*c* and 73*d*, operators (OP) 73*e* and 73*f*, a data latch 73*g*, a D/A converter (D/A) 73*h*, an F/V converter (F/V) 73I, and an A/D converter (A/D) 73*j*.

The operation inhibit signal output circuit 74 fetches the second pulse signal 102 to detect if the rotating speed of the new paper roll drive means 30 is being changed or not, and outputs an operation inhibit signal to inhibit the operation performed by the control signal output circuit when the driving speed of the new paper roll drive means 30 is found being changed.

The speed matching signal output circuit 75 outputs a speed matching signal 105 when the calculation result by the control signal output circuit 73 becomes a value indicating that the peripheral speed of the new paper roll R substantially agrees with the traveling speed of the traveling web W. The speed matching signal output circuit 75 comprises an operator (OP) 75*a*, a dip switch (DIPSW) 75*b*, comparators (COMP) 75*c* and 75*d*, and a dip switch (DIPSW) 75*e*.

The splicing operation of the automatic splicing system according to this invention in a printing system that is processing apparatus P will be described in the following, referring to FIGS. 1 and 2, and mainly in accordance with FIG. 3.

During the operation of a printing system as processing apparatus P, a traveling web W is fed from a paper roll supported by the support member pair 305 of a pair of the support arm pair 303, from among the two paper rolls supported by the support section 300. This state is shown in FIGS. 1 and 2. During the period, the printing cylinder C for taking up the traveling web W, printing on it and delivering it to the downstream side, and the drive means D are actuated. Along with this, the first pulse signal output means 20 is actuated to output the number of first pulse signals 101 corresponding to the traveling distance (speed) of the traveling web W. The first pulse signals 101 are input into the traveling speed recognition circuit 71 of the control signal output means 70 for further processing.

The traveling speed recognition circuit 71 causes the counter 71*a* to count the number of first pulse signals 101 being input. Upon completion of counting a predetermined number of the first pulse signals 101 that is set in the comparator 71*b* by the dip switch 71*c*, the counter 71*a* is reset to "0," and repeats counting again from "1." Every time counting by the counter 71*a* is repeated (at every counting frequency), the comparator 71*b* receives each count output from the counter 71*a*, and outputs first and final count signals. The first and final count signals output by the comparator 71*b* are input into the flipflop circuit 71*d*.

The output of the flipflop circuit 71*d* is changed to a HIGH level upon receiving the first count signal (in synchronism with the rise thereof, and to a LOW level upon receiving the final count signal (in synchronism with the fall thereof). The output of the flipflop circuit 71*d* is input into any one terminal of the 2-input AND gate circuit 71*e*.

The clock pulse signals 103 output by the clock pulse signal output means (OSC) 60 are input into the other terminal of the AND gate circuit 71*e*. The AND gate circuit 71*e* outputs signals corresponding to the clock pulse signals 103 as long as the output of the flipflop circuit 71*d* is maintained at a HIG level, that is, as long as the first pulse signals 101 are output up to a number preset by the dip switch 71*c*. The counter 71*f* counts the number of signals corresponding to the clock pulse signals 103, and outputs the count value.

The value set by the dip switch 71*c* is made equal to the number of the first pulse signals 101 output by the first pulse signal output means 20 when the traveling web W is caused to travel by the rotation of the printing cylinder C over a distance equal to the distance between the first detection bar 8 and the second detection bar 9 in the detection mark 5 shown in FIG. 4. That is, the value of dip switch 71*c* is set so that the distance the traveling web W travels during the time in which the first pulse signals 101 are output up to a number set by the dip switch 71*c* becomes equal to the interval between the first detection bar 8 and the second detection bar 9 in the detection mark 5. As a result, the AND gate circuit 71*e* is opened and the counter 71*f* counts the number of clock pulse signals 103 during the period in which the traveling web W travels a distance equal to the interval between the first detection bar 8 and the second detection bar 9. As noted earlier, the interval between the first detection bar 8 and the second detection bar 9 equals to the distance the traveling web W travels at a constant speed during the period in which the first pulse signals 101 are output up to "100" pulses. Consequently, the value set by the dip switch is "100."

As the traveling web W is consumed, the second pulse signal output means 40, which is operated via the support member 305*a*, and the gears 44 and 42, outputs second pulse signals 102 corresponding to the rotation of the support member 305*a* caused by the travel of the traveling web W. As described above, the number of outputs per unit time of the second pulse signals 102 is inversely proportional to the diameter of the roll from which the traveling web W is being fed. The second pulse signals 102 are processed in relation to the first pulse signals 101 output by the first pulse signal output means 20. With this processing, it is detected that the diameter of the roll from which the traveling web W is fed becomes a predetermined first diameter and then a second diameter that is smaller than the first diameter, and a first diameter detection signal and a second diameter detection signal are output, respectively. This first diameter detection signal is a splicing start signal SS.

That is, means for detecting that the diameter of the traveling web W (not shown) becomes equal to a predetermined diameter calculates the traveling distance per unit time of the traveling web W from the number of the first pulse signals 101 output per unit time, calculates the number of rotation per unit time of the roll from which the traveling web W is fed based on the number of the second pulse signals 102, obtains the outer peripheral length of the roll by dividing the calculated traveling distance by calculated rotation, and then detects the diameter of the roll from which the traveling web W is fed at that moment based on the obtained outer peripheral length.

The automatic splicing processing in this embodiment can be summarized as follows. The automatic splicing processing starts with the detection of the splicing start signal SS (first diameter detection signal). Prior to this, the traveling speed recognition circuit 71 has been actuated upon receipt of an output 101 from the first pulse signal output means 20, as described earlier. Upon detection of the splicing start signal SS, the support section 300 is actuated to cause a new paper roll R to move to a predetermined position (splicing position) with respect to the traveling web W. Before the second diameter detection signal is detected, the control signal output means 70 controls the new paper roll drive means 30 based on the output 101 from the first pulse signal output means 20 and the output 100 from the mark detecting means 10 to cause the peripheral speed of the new paper roll R to agree with the traveling speed of the traveling web W. After the second diameter detection signal has been detected, the splicing section 200 splices the new paper roll R to the traveling web W under the control of the splicing section control means 203.

As the splicing start signal SS is output, the shaft rotating means 309 of the support section 300 is actuated to cause the shaft 301 to rotate in a predetermined direction, causing the support arm pairs 302 and 303 to move to the splicing phase. The phase after the support arm pairs 302 and 303 have been moved is shown in FIG. 2.

The operation of the shaft drive means 309 is stopped by a detection signal output by the detection means 400. This detection signal is output when the outer peripheral surface of the new paper roll R arrives at a predetermined position (that is, the position of the new paper roll R at the splicing phase) with respect to the traveling web W. The detection signal output by the detection means 400 becomes a control start instruction signal 401 for instructing the operation of the control signal output means 70.

The splicing start signal SS actuates the mark detecting means carriage 90 for causing the mark detecting means 10 to move to and stop at a position appropriate for mark detection. That is, the rack 91 is caused by the splicing start signal SS to move to position remotest from the outer peripheral surface of the new paper roll R, as described earlier. As a result of this movement, the mark detecting means 10 installed on the rack 91 is caused to move to a position remotest to the outer peripheral surface of the new paper roll R. A detector (not shown) detects that the rack 91 is moved to the remotest position, and outputs a detection signal, which in turn stops the mark detecting means carriage 90.

In this state, as the detection signal of the detection means 400, that is, the control start instruction signal 401 is output, the mark detecting means carriage 90 is actuated in the direction opposite to the aforementioned case. This causes the mark detecting means 10 to move closer to the outer peripheral surface of the new paper roll R. The mark detecting means 10 is caused to stop at a position separated by a predetermined interval from the outer peripheral surface of the new paper roll R. To achieve this, a peripheral surface position sensor (not shown) is provided on the rack 91 at a position separated by a predetermined interval from the mark detecting means 10. The peripheral surface position sensor detects the outer peripheral surface of the new paper roll R and outputs an outer peripheral surface detection signal, which in turn causes the mark detecting means 10 to stop.

The mark detecting means 10 is caused to move by the actuation of a solenoid actuator (not shown) in accordance with the control start instruction signal 401 so that the cover 11 opens the front surface of the laser beam emitting/receiving lens. Thus, the mark detecting means 10 is brought into a state ready for detecting the detection mark 5 provided on the outer peripheral surface of the new paper roll R.

The control signal output means 70 is operated in the following manner as the control start instruction signal 401 is input. As shown in FIG. 3, the dip switch 73*a* of the control signal output circuit 401 holds the initial setting of the operating speed of the new paper roll drive means 30 in the data latch 73*g*. The value (digital value) held in the data latch 73*g* is converted into a voltage signal that is an analog value by the D/A converter 73*h* and output as a control signal 104 to the rotation control means 50.

As shown in FIG. 2, the rotation control means 50 causes the drive unit 34 of the new paper roll drive means 30 to rotate based on the control signal 104 corresponding to this initial setting. The rotation of the drive unit 34 is transmitted to the toothed pulley 310 enmeshed with the double-toothed belt 33 via the double-toothed belt 33 provided between the toothed pulley 32 and the toothed pulley 31 connected to the output shaft of the drive unit 34. Furthermore, the rotation of the drive unit 34 causes the new paper roll R supported on the support arm pair 302 by the support member pair 304 to rotate via the support member 304*a* rotating integrally with the toothed pulley 310.

As the support member 304*a* rotates, the second pulse signal output means 40 is actuated via the gear 43 rotating integrally therewith and the gear 41 enmeshed with the gears to output the second pulse signal 102.

The second pulse signal 102 thus output is converted into a signal for calculation in the control signal output circuit 73 of the control signal output means 70, as will be described later, and processed in the calculation inhibit signal output circuit 74 to output a calculation inhibit signal. Furthermore, the second pulse signal 102 that is output is input as a feedback signal to the rotation control means 50.

As described above, as the new paper roll R is caused to rotate, the detection mark 5 provided on the outer peripheral surface of the new paper roll R is caused to pass the position facing the detection mark 5 on the mark detecting means 10, which in turn detects the detection mark 5. The detection of the detection mark 5 is repeated at every rotation of the new paper roll R until the new paper roll R is spliced to the traveling web W. Along with this, the following processing is repeated.

Figure 5A:
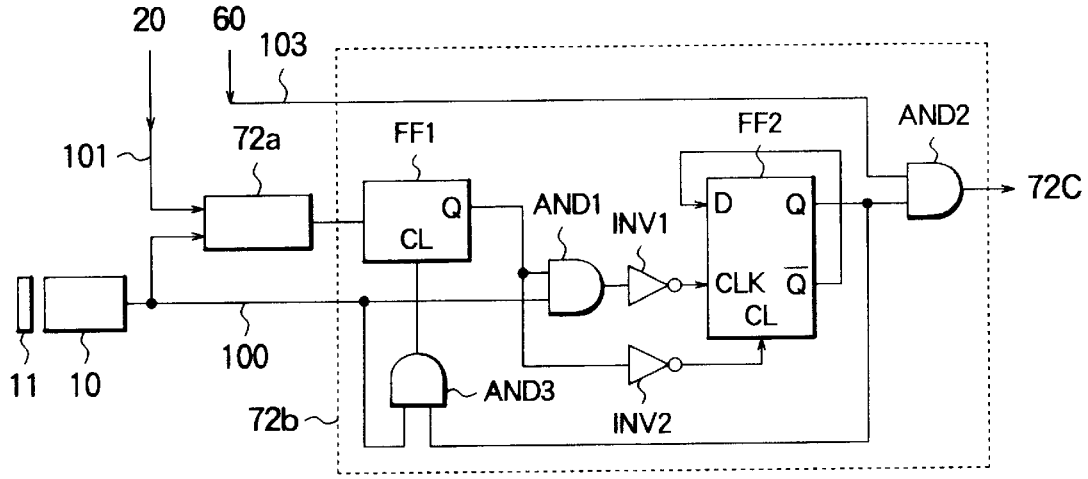
FIG. 5A is a diagram of assistance in explaining the configuration of an AND circuit of the control signal output means shown in FIG. 3.
Figure 5B:
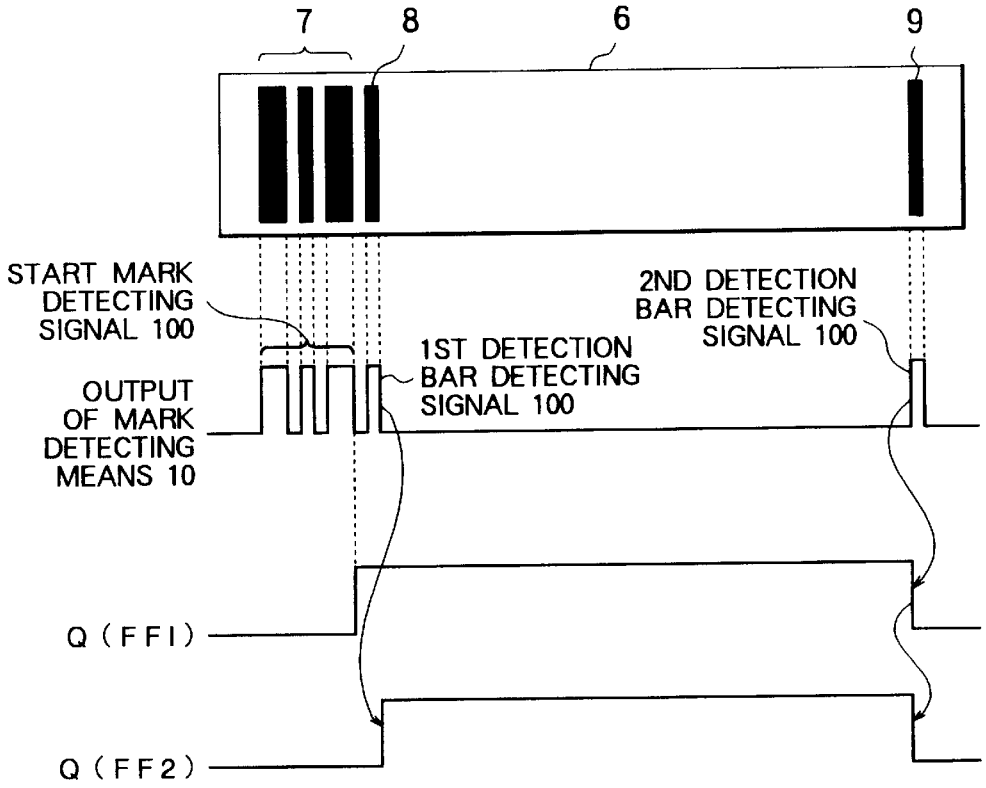
FIG. 5B is a diagram of assistance in explaining the operation of the AND shown in FIG. 5A.
Figure 6:
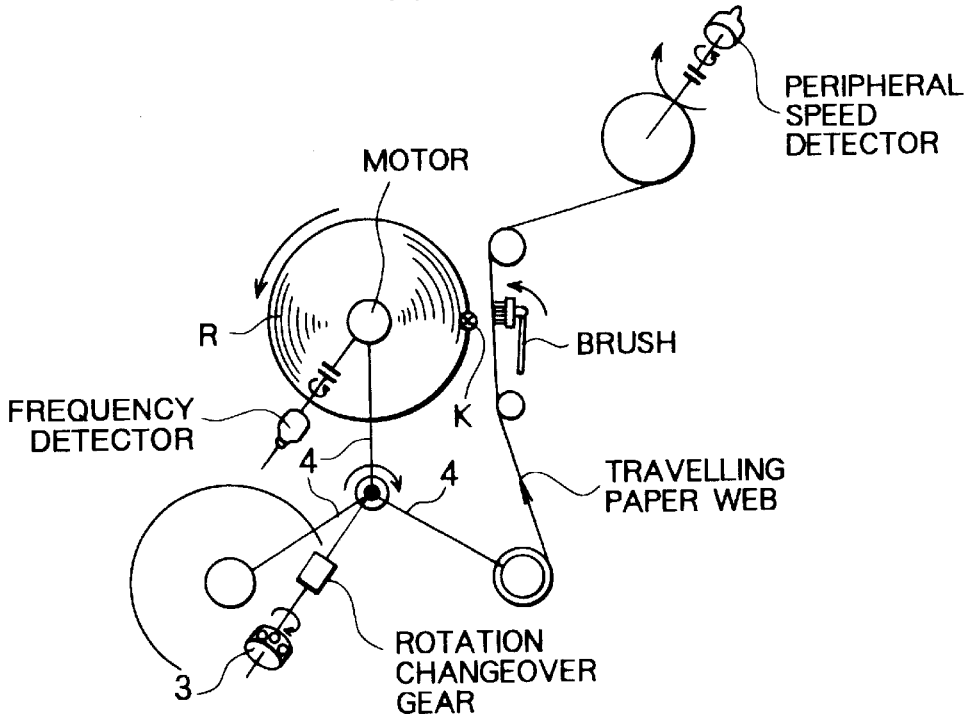
FIG. 6 PRIOR ART
FIG. 6 is a diagram of assistance in explaining the configuration of an arrangement for obtaining a value proportional to the diameter value of a new paper roll in the prior art.
Figure 7:
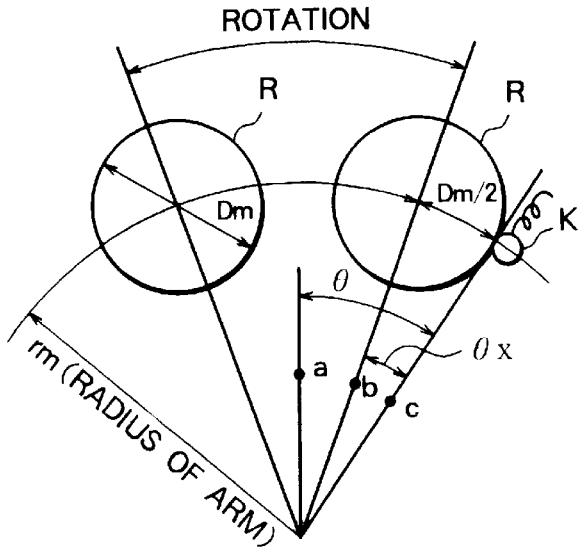
FIG. 7 PRIOR ART
FIG. 7 is a diagram of assistance in explaining an arrangement for extracting a signal relating to the peripheral surface length of a new paper roll in the prior art.

As shown in FIG. 5B, the mark detecting means 10 detects the start mark 7. The detection signal 100 for the start mark 7 is input into the start mark detection confirmation circuit 72 in the peripheral speed recognition section 72 of the control signal output means 70. The start mark detection confirmation circuit 72*a* is connected to the first pulse signal output means 20 so that the first pulse signals 101 can be input at all times. The detection signal 100 for the start mark 7 is input in the state where the first pulse signals 101 are input. During the period in which a laser beam emitted by the mark detecting means 10 passes a plurality of bars of the start mark 7, for example, the mark detecting means 10 that receives the reflected light from the bars outputs detection signals for those bars. The start mark detection confirmation circuit 72*a* detects the start mark 7 upon receipt of a plurality of bar detection signals having different transmission time corresponding to the layout of a plurality of bars of the start mark 7.

When the detection signal 100 for the start mark 7 is input in the state where the first pulse signals 101 are input, the start mark detection confirmation circuit 72*a* outputs a start mark detection confirmation signal (HIGH level signal) to one terminal of the AND circuit 72*b*. The AND circuit 72*b* has a configuration shown in FIG. 5A. The start mark detection confirmation signal is input to the flipflop circuit FF1 of the AND circuit 72*b*. The start mark detection confirmation circuit 72*a* stops (brings to a LOW level) the output of the start mark detection confirmation signal in synchronism with the detection signal 100 of the second detection bar 9 (in synchronism with the rise of the HIGH level signal).

When the start mark detection confirmation signal is input, the output Q of the flipflop circuit FF1 becomes a HIGH level at a timing shown in FIG. 5B. This HIGH level is input into any one terminal of the 2-input AND gate circuit AND1 and the clear terminal CL of the flipflop circuit FF2.

The mark detecting means 10 detects the first detection bar 8 and outputs the detection signal 100 for the first detection bar 8, as shown in FIG. 5B. As the detection signal 100 for the first detection bar 8 is input into the other terminal of the AND gate circuit AND1 that is in the aforementioned state, the AND gate circuit AND1 outputs a signal corresponding to it. This signal is inverted by the inverter INV1 and input into the clock input terminal CLK of the flipflop circuit FF2. With this, the output Q of the flipflop circuit FF2 becomes a HIGH level at the timing of the fall of the detection signal 100 for the first detection bar 8, as shown in FIG. 5B. The output Q of the flipflop circuit FF2 is input into one terminal each of the 2-input AND gate circuits AND2 and AND3.

The other terminal of the AND gate circuit AND2 is connected to the clock pulse signal output means 60 so that the clock pulse signal 103 can be input into that terminal. When the HIG-level output Q of the flipflop circuit FF2 is input, the AND gate circuit AND2 is opened during the HIGH-level period, and outputs a signal corresponding to the clock pulse signal 103.

Next, the mark detecting means 10 detects the second detection bar 9, and outputs the detection signal 100 for the second detection bar 9, as shown in FIG. 5B. The detection signal 100 for the second detection bar 9 is input into the other terminal each of the AND gate circuits AND1 and AND3.

At this point of time, the HIGH-level output Q of the flipflop circuit FF2 is kept input in the AND gate circuit AND3. As the detection signal 100 for the second detection bar 9 is input, therefore, the AND gate circuit AND3 outputs a signal corresponding to the detection signal 100 for the second detection bar 9 into the clear terminal CL of the flipflop circuit FF1. With this, the output Q of the flipflop circuit FF1 becomes a LOW level at the timing of the rise of the detection signal 100 of the second detection bar 9, as shown in FIG. 5B. Consequently, the AND gate circuit AND1 is closed and brought into a state where the AND gate circuit AND1 outputs no signal (HIGH-level signal) even if the detection signal 100 for the second detection bar 9.

As an inverted signal of the output Q of the flipflop circuit FF1 is input into the flipflop circuit FF2, on the other hand, the output Q of the flipflop circuit FF2 becomes a low level at the timing of the rise of the detection signal 100 of the second detection bar 9, as shown in FIG. 5B. As the output Q of the flipflop circuit FF2 becomes a LOW level, the AND gate circuit AND2 is closed and stops outputting a signal corresponding to the clock pulse signal 103.

With the above operations, the AND circuit 72*b* is kept opened during the period from the input of the detection signal for the first detection bar 8 till the output of the detection signal for the second detection bar 9, following the output of the start mark detection confirmation signal, that is, during the period in which the outer peripheral surface of the new paper roll R travels over a distance between the first detection base 8 and the second detection bar 9, and outputs an output signal corresponding to the input of the clock pulse signal 103 to the counter 72*c*. The counter 72*c* counts the number of signals output by the AND circuit 72*b*, and outputs the count value.

The configuration and construction of the AND circuit 72*b* shown in FIGS. 5A and 5B represent an embodiment of this invention, and this invention is not limited to the configuration and operation shown above.

The count value output by the counter 71*f* of the traveling speed recognition circuit 71 and the count value output by the counter 72*c* of the peripheral speed recognition circuit 72 are each input into the comparator 73*d* and the arithmetic unit 73*e*.

The comparator 73*d* compares the aforementioned two input count values, and outputs the difference between them as the comparison result to the comparator 73*c*. That is, the number of the clock pulse signals counted by the counter 71*f* during the period in which the traveling web W travels over a distance equal to the interval between the first detection bar 8 and the second detection bar 9, and the number of the clock pulse signals 103 counted by the counter 72*c* during the period in which the outer peripheral surface of the new paper roll R travels over a distance between the first detection bar 8 and the second detection bar 9 are compared, and the difference of the count values is obtained. The absolute output value of the comparator 73*d* input into the comparator 73*c* is compared with the constant K1 set by the dip switch 73*b* in the comparator 73*c*. When the absolute output value of the comparator 73*d* is smaller than the constant k1, the comparator 73*c* outputs a held value alteration inhibit signal for inhibiting the alteration of the value held by the data latch 73*g*. Consequently, the peripheral speed of the new roll paper R at that point of time is maintained. The constant K1 is "3," for example. With this, the peripheral speed of the new paper roll R is prevented from being repeatedly and unstably increasing or decreasing.

The arithmetic unit 73*e* divides the count value of the counter 72*c* by the count value of the counter 71*f*, and outputs the quotient. If both values are equal, that is, if the traveling speed of the traveling web W is equal to the peripheral speed of the new paper roll R, the output of the arithmetic unit 73*e* becomes "1." The output of the arithmetic unit 73*e* is input into the arithmetic unit 73*f* and the arithmetic unit 75*a* of the speed matching signal output circuit 75.

The second pulse signal 102 output by the second pulse signal output means 40 is converted into a voltage signal by an F/V converter 73I. The voltage signal is then converted by the A/D converter 73*j* into digital signal, which is input into the arithmetic unit 73*f*. The arithmetic unit 73*f* multiplies this digital signal by the output of the arithmetic unit 73*e*, and outputs the product to the data latch 73*g*. When the comparator 73*c* does not output any held value alteration inhibit signal, the data latch 73*g* holds the output of the arithmetic unit 73*f* in place of the previous held value. The held value in the data latch 73*g* is converted into a voltage signal by the D/A converter 73*h*, and output as the control signal 104 to the rotation control means 50.

The second pulse signal 102 output by the second pulse signal output means 40 is input as a feedback signal into the rotation control means 50 in which the control signal 104 is input. The second pulse signal 102 input as a feedback signal into the rotation control means 50 is converted into a signal that is comparable with the control signal 104 through appropriate processing in the rotation control means 50, and compared with the control signal 104. Thus, the rotation control means 50 controls the rotation of the drive unit 34 of the new paper roll drive means 30 based on the comparison of the control signal 104 with the signal converted from the second pulse signal 102 as a feedback signal.

If the peripheral speed of the new paper roll R is lower than the traveling speed of the traveling web W, for example, the output of the arithmetic unit 73*e* becomes a value larger than "1" since the count value of the counter 72*c* on the peripheral speed side becomes larger than the count value of the counter 71*f*. As a result, the output (held value in the data latch 73*g*) of the arithmetic unit 73*f* becomes a value larger than the digital signal output by the A/D converter 73*j*. Thus, the rotation control means 50 controls so that the rotation of the drive unit 34 of the new paper roll drive means 30 becomes higher than the previous speed, with the result that the peripheral speed of the new paper roll R becomes a value closer to the traveling speed of the traveling web W.

The operation inhibit signal output circuit 74 detects a change in the number of outputs per unit time of the second pulse signal 102 output by the second pulse signal output means 40. Based on the detection results, the operation inhibit signal output circuit 74 outputs an operation inhibit signal for inhibiting operation to the two arithmetic units 73*e* and 73*f* of the control signal output circuit 73 until the second pulse signal 102 is brought to a substantially stable state (that is, a state where a change in the number of outputs per unit time of the second pulse signal 102 subsides into a predetermined range).

With the operation inhibit signal, the held value in the data latch 73*g* that is the basis of the control signal 104 is prevented from being changed before the rotation of the new paper roll R by the new paper roll drive means 30 reaches a state controlled by the control signal 104. Thus, the stable and accurate rotation of the new paper roll R can be maintained, and it becomes possible to cause the peripheral speed of the new paper roll R to agree with the traveling speed of the traveling web W in a stable matter in a short period.

The arithmetic unit 75*a* of the speed matching signal output circuit 75 multiplies the output of the arithmetic unit 73*e* by the constant K2 set by the dip switch 75*b*, and the product is output to the comparator 75*c*. The comparator 75*c* compares the output of arithmetic unit 75*a* with the constant K2 set by the dip switch 75*b*, and outputs the difference between both as the comparison result to the comparator 75*d*. The comparator 75*d* compares the absolute value of the comparison result output by the comparator 75*c* (the absolute difference value) with the constant K3 set by the dip switch 75*e*. The comparator 75*d* outputs the speed matching signal 105 when the absolute output value of the comparator 75*c* is smaller than the constant K3.

The constant K2 set by the dip switch 75*b* is "1000," for example, and the constant K3 set by the dip switch 75*e* is "5," for example. Consequently, when the peripheral speed (the counter value of the counter 72*c*) of the new paper roll R is within the range of 5/1000=0.5% of the traveling speed (count value of the counter 71*f*) of the traveling web W, the speed matching signal 105 is output. When the output of the arithmetic unit 73*e* is substantially "1," that is, when the traveling speed of the traveling web W substantially agrees with the peripheral speed of the new paper roll R (the relative speed of both is "0"), the speed matching signal 105 is output.

As described above, the traveling web W is kept consumed even when control is effected so as to agree the traveling speed of the traveling web W with the peripheral speed of the new paper roll R. When it is detected that the diameter of the paper roll from which the traveling web W is fed becomes a predetermined second diameter, the second diameter detection signal is output. The detection of the second diameter is carried out in the same manner as the detection of the first diameter.

Both the speed matching signal 105 and the second diameter detection signal are input into the splicing section control means 203 for controlling the operation of the splicing section 200, as shown in FIG. 1. In the state where the new paper roll R is being rotated, both the speed matching signal 105 and the second diameter detection signal are input into the splicing section control means 203 simultaneously at a certain point of time. After this state is reached, when the headmost detection signal 100 of the detection mark 5 on the rotating new paper roll R, that is, the detection signal 100 of the start mark 7 is input into the splicing section control means 203, the splicing section control means 203 causes the brush roller 201 as a pushing member and the cutter member 202 to sequentially operate at an appropriate timing. With this operation, the start end S of the new paper roll R is spliced to the traveling web W, and the upstream side of the spliced position of the traveling web W is cut off to complete splicing operation. Description of the splicing section control means 203 has been omitted because the spicing section control means 203 may be of the same construction as conventional splicing systems and does not directly related to this invention.

As described above, according to this invention, it is directly detected via a detection mark provided on the outer peripheral surface of a new paper roll that the outer peripheral surface of the new paper roll is caused to move by a predetermined length by the rotation of the new paper roll, and the time required for the outer peripheral surface of the new paper roll to move is caused to agree with the time required for the traveling web to travel over the aforementioned predetermined length, thereby the peripheral speed of the new paper roll being caused to agree with the traveling speed of the traveling web. According to this invention, therefore, the matching of both speeds can be accomplished with higher accuracy that with conventional automatic splicing systems. In particular, automatic splicing is possible even with conventional automatic splicing systems where splicing has been impossible to a high-speed traveling web due to too large a difference between the traveling speed of the traveling web and the peripheral speed of the new paper roll.

According to this invention, the peripheral speed in the vicinity of a portion of the new paper roll at which splicing is made can be caused to agree with the traveling speed of the traveling web by providing a detection mark in the vicinity of the start end of the new paper roll. According to this invention, therefore, the peripheral speed in the vicinity of the start end at which splicing is made can be caused to agree with the traveling speed of the traveling web even when the new paper roll is slightly offset. As a result, the difference in speed at a portion where splicing is made can be eliminated, resulting in more positive splicing.

What is claimed is:

1. An automatic paper-web splicing system for rotating a new paper roll being spliced, causing the peripheral speed of said new paper roll to agree with the traveling speed of a traveling web, splicing the start end of said new paper roll to said traveling web so as to continuously supply said spliced new paper roll and traveling web to processing apparatus for predetermining processing, said automatic paper-web splicing system comprising;

traveling speed detection means for detecting the traveling speed of said traveling web, a detection mark comprising at least two marks provided a predetermined interval apart in the circumferential direction of said new paper roll on the surface in the vicinity of the start end of said new paper roll, new paper roll rotating means for rotating said new paper roll and controlling the peripheral speed thereof in a variable manner, mark detecting means for detecting said two marks as said detection mark during the rotation of said new paper roll, calculating means for calculating the peripheral speed of said new paper roll based on detection signals for said two marks as said detection mark detected by said mark detecting means, and splicing means for splicing the start end of said new paper roll to said traveling web;

said new paper roll rotating means controlling the rotation of said new paper roll so that the peripheral speed calculated by said calculating means agrees with the traveling speed of said traveling web detected by said traveling speed detecting means, and said splicing means splicing the start end of said new paper roll to said traveling web in a state where the peripheral speed of said new paper roll agrees with the traveling speed of said traveling web, first pulse signal output means for outputting a first pulse signal corresponding to the traveling speed of said traveling web, second pulse signal output means for outputting a second pulse signal corresponding to the rotating speed of said new paper roll rotating means, clock pulse signal output means for outputting a clock pulse signal of a predetermined frequency, and control means for forming a control signal for said new paper roll rotating means based on detection signals for said two marks, said first pulse signal, said second pulse signal and said clock pulse signal;

said traveling speed detecting means detecting said traveling speed based on said first pulse signal, and said new paper roll rotating means being controlled by said control means, said detection mark comprises first and second detection bars used as said two marks and provided in parallel with each other, an interval between said first and second detection bars being equal to the distance that said traveling web travels during the period in which said first pulse signal output means outputs a predetermined number of said first pulse signals, said traveling speed detecting means counts the first pulse signals output by said first pulse signal output means, counts the clock pulse signals output by said clock pulse signal output means until the count value of said first pulse signals reaches a predetermined number, said peripheral speed calculating means counts the clock pulse signals output by said clock pulse signal output means during the period during which said mark detecting means detects said first detection bar and then said second detection bar, and said control means calculates a first calculated value by comparing and calculating the number of clock pulse signals counted by said traveling speed detecting means and the number of clock pulse signals counted by said peripheral speed calculating means, calculating a second calculated value using said first calculated value and a processed value formed based on the second pulse signal output by said second pulse signal output means, holds said second calculated value as control data, and controls the rotating speed of said new paper roll rotating means based on said control data.

2. An automatic paper-web splicing system as set forth in claim 1 wherein said detection mark is provided on the surface of said new paper roll by pasting a mark tab on which said detection mark is printed on the surface in the vicinity of the start end of said new paper roll.

3. An automatic paper-web splicing system as set forth in claim 1 wherein said detection mark comprises a start mark comprising a plurality of bars arranged at predetermined intervals and in parallel with said first and second detection bars.

4. An automatic paper-web splicing system as set forth in claim 1 further comprising;

a mark detecting means carriage for transporting said mark detecting means and stopping said mark detecting means at a position at which the interval between said mark detecting means and the outer peripheral surface of said new paper roll is a value within a predetermined range.

5. An automatic paper-web splicing means as set forth in claim 1 further comprising;

means for comparing the number of clock pulse signals counted by said traveling speed detecting means and the number of clock pulse signals counted by said peripheral speed calculating means and inhibiting the alteration of said control data when the comparison result is smaller than a predetermined value.

6. An automatic paper-web splicing means as set forth in claim 1, further comprising;

means for inhibiting the calculation of said first and second calculated values in said control means, when the rotating speed of said new paper roll rotating means is being changed, based on the second pulse signal output by said second pulse signal output means.

7. An automatic paper-web splicing means as set forth in claim 1, further comprising;

means for outputting a speed matching signal to said splicing means when said first calculated value is a value indicating that the peripheral speed of said new paper roll substantially agrees with the traveling speed of said traveling web.

8. An automatic paper-web splicing means as set forth in claim 1, further comprising;

diameter detecting means for detecting the diameter of a paper roll from which said traveling web is fed, and when said diameter becomes a predetermined first value and a second value that is smaller than said first value, outputting first and second diameter detection signals, respectively, and a support section for holding a plurality of said paper rolls and placing said new paper roll at a predetermined position with respect to said traveling web;

said traveling speed detecting means being actuated prior to the output of said first diameter detection signal, said support section placing said new paper roll at a predetermined position with respect to said traveling web in accordance with the output of said first diameter detection signal from said diameter detecting means, said new paper roll rotating means causing the peripheral speed of said new paper roll to agree with the traveling speed of said traveling web in accordance with the control signal from said control means prior to the detection of said second diameter detection signal from said diameter detecting means, and said splicing means splices said new paper roll to said traveling web after the output of said second diameter detection signal from said diameter detecting means.

9. An automatic paper-web splicing method for rotating a new paper roll being spliced, causing the peripheral speed of said new paper roll to agree with the traveling speed of a traveling web, splicing the start end of said new paper roll to said traveling web so as to continuously supply said spliced new paper roll and traveling web to processing apparatus for predetermining processing, said automatic paper-web splicing method comprising the steps of;

generating a first pulse signal corresponding to the traveling speed of said traveling web, generating a clock pulse signal of a predetermined frequency, and detecting said traveling speed by counting the first pulse signals and counting the clock pulse signals until the count value of said first pulse signals reaches a predetermined number, rotating the new roll, providing a detection mark comprising at least two marks provided a predetermined interval apart in the circumferential direction of said new paper roll on the surface in the vicinity of the start end of said new paper roll, said detection mark comprises first and second detection bars used as said two marks and provided in parallel with each other, an interval between said first and second detection bars being equal to the distance that said traveling web travels during the period in which said first pulse signal output means outputs a predetermined number of said first pulse signals, generating a second pulse signal corresponding to the rotating speed of said new paper roll rotating means, detecting said two marks that are said detection mark when said new paper roll is rotated, calculating the peripheral speed of said new paper roll based on detection signals for said two marks that are said detection mark by counting the clock pulse signals output by said clock pulse signal output means during the period between detecting said first detection bar and then said second detection bar, controlling the rotation of said new paper roll so that the calculated peripheral speed agrees with the traveling speed of said traveling web, said controlling forming a control signal for said rotating of the new paper roll based on detection signals for said two marks, said first pulse signal, said second pulse signal and said clock pulse signal, said controlling calculating a first calculated value by comparing and calculating the number of clock pulse signals counted by said traveling speed detecting and the number of clock pulse signals counted by said peripheral speed calculating, calculating a second calculated value using said first calculated value and a processed value formed based on the second pulse signal, holding said second calculated value as control data, and controlling the rotating speed of said new paper roll based on said control data, splicing the start end of said new paper roll to said traveling web in a state where said peripheral speed agrees with the traveling speed of said traveling web.

10. An automatic paper-web splicing method as set forth in claim 9 wherein said detection mark is provided by pasting a mark tab on which said detection mark is printed on the surface in the vicinity of the start end of said new paper roll.

11. An automatic paper-web splicing method as set forth in claim 9 further comprising the steps of, detecting the diameter of a paper roll from which said traveling web is fed, and when said diameter becomes a predetermined first value and a second value that is smaller than said first value, outputting first and second diameter detection signals, respectively, and placing said new paper roll at a predetermined position with respect to said traveling web;

said traveling speed of said traveling web being detected prior to the output of said first diameter detection signal, said new paper roll being placed at a predetermined position with respect to said traveling web in accordance with the output of said first diameter detection signal, the peripheral speed of said new paper roll being caused to agree with the traveling speed of said traveling web by the time of detection of said second diameter detection signal, and said new paper roll being spliced to said traveling web after the output of said second diameter detection.

12. A method for automatically splicing a new roll to a traveling web, the method comprising the steps of:

generating a first pulse signal with a plurality of first pulses, each of said first pulses corresponding to movement of a predetermined amount of the traveling web;

repetitively counting a web distance count of said first pulses until said web distance count reaches a predetermined web distance;

providing a clock signal with a plurality of clock pulses;

counting a web clock count of said clock pulses occurring during said counting of said web distance count;

providing start and stop detection marks on an outside circumferential surface of the new roll;

rotating the new roll;

repetitively detecting passage of said start and stop detection marks;

counting a roll clock count of said clock pulses between said passage of said start detection mark and said stop detection mark;

comparing said web clock count with said roll clock count;

adjusting said rotating of the new roll to cause said web clock count and said roll clock count to be in a predetermined proportion to each other;

splicing the new roll to the traveling web when said web clock count and said roll clock count are in said predetermined proportion to each other.

* * * * *